US006840609B2

(12) United States Patent
Lo et al.

(10) Patent No.: US 6,840,609 B2
(45) Date of Patent: Jan. 11, 2005

(54) STRUCTURE OF INK CARTRIDGE AND METHOD FOR PRODUCING THE SAME

(75) Inventors: Chin-Tien Lo, Taoyuan (TW); Chu-Yin Deng, Taoyuan (TW)

(73) Assignee: Microjet Technology, Ltd., Hsin-Chu (TW)

( * ) Notice: Subject to any disclaimer, the term of this patent is extended or adjusted under 35 U.S.C. 154(b) by 0 days.

(21) Appl. No.: 10/358,595

(22) Filed: Feb. 5, 2003

(65) Prior Publication Data

US 2004/0150700 A1 Aug. 5, 2004

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 5,926,195 A * 7/1999 Domhoff et al. ..... 347/87
6,145,975 A * 11/2000 Kotaki et al. ..... 347/87
6,260,961 B1 * 7/2001 Seu et al. ..... 347/87
6,290,348 B1 * 9/2001 Becker et al. ..... 347/87
6,454,387 B1 * 9/2002 Haldorsen ..... 347/29
2003/0058315 A1 * 3/2003 Lee et al. ..... 347/87

* cited by examiner

*Primary Examiner*—Anh T. N. Vo
(74) *Attorney, Agent, or Firm*—Madson & Metcalf

(57) ABSTRACT

A structure of an ink cartridge is provided. The structure includes a main body, a first sealing element and a second sealing element. The main body comprises a first, a second and a third chambers. The first chamber is separated with the second and the third chambers via a first partitioning plate. The second chamber is separated with the third chamber via a second partitioning plate. The first partitioning plate is substantially perpendicular to the second partitioning plate. The first, the second and the third chambers have a first, a second and a third exit ports at bases thereof. The first exit port is directly used as a first opening for flowing out the first ink. The first and second sealing elements cooperated with a bottom surface of the main body to define channels and openings for inks to flow therethrough.

20 Claims, 8 Drawing Sheets

STRUCTURE OF INK CARTRIDGE AND METHOD FOR PRODUCING THE SAME

FIELD OF THE INVENTION

The present invention relates to a structure of an ink cartridge, and more particularly to a structure of an ink cartridge with high airtight and watertight properties. The present invention also relates to a method for producing such ink cartridge.

BACKGROUND OF THE INVENTION

With increasing development of personal computer, printers are widely used as peripheral devices of computers. Recently, color printers are greatly developed and are generally classified into two types: laser printers and ink jet printers. The cost of the laser printer is much more than that of the ink jet printer. Since the use of the ink jet printer provides an acceptable good printing quality and is cost-effective, the ink jet printer is relatively popular.

It is well known that the structure and operation of an ink cartridge are very important for determining printing quality of an ink jet printer. FIG. 1 is an exploded view illustrating a structure of a conventional ink cartridge. The ink cartridge principally comprises a main body 11, a bottom cover plate 12 and a top cover plate 13. Take a tri-color ink cartridge for example. The main body 11 comprises three ink chambers 111, 112, 113 from left to right so as to accommodate different colors of inks such as red, yellow and blue ink. The bottom cover plate 12 along with a bottom surface 114 of the main body 11 will define corresponding channels for guiding the inks to flow out, as will be illustrated in FIG. 2 in more greater details. The top cover plate 13 is attached to a top surface of the main body 11 for sealing the inks contained in the ink chambers. Generally, the main body 11, the bottom cover plate 12 and the top cover plate 13 are separately molded. Then, the bottom cover plate 12 and the top cover plate 13 are boned to the bottom surface and top surface of the main body 11, respectively, by using an ultrasonic welding technology.

FIG. 2 is a bottom view illustrating the bottom surface 114 of the ink cartridge main body 11. There are exit ports 1110, 1120 and 1130 at the base of each ink chambers 111, 112 and 113, respectively. The bottom surface 114 has some protruding structures such as channel plates, strips and edge ribs. The channel plates 1141, 1142 and 1143 extend from the exit ports 1110, 1120 and 1130, respectively, to an exit region 1144. The strips 1145 are located in the peripheries of the channel plates 1141, 1142 and 1143, and thus recesses 1146 are formed between the strips 1145 and each channel plate. The edge ribs 1147 are located at edge surfaces of the bottom surface 114.

FIG. 3 is a top view illustrating the bottom cover plate 12. The bottom cover plate 12 has rising strips 121 corresponding to recesses 1146 formed on the bottom surface 114 of the ink cartridge main body 11. The rising strips 121 are fitted into the recesses 1146 when the bottom cover plate 12 is engaged with the bottom surface 114 of the main body 11. The bottom cover plate 12 will be boned into the bottom surface 114 of the main body 11 by using an ultrasonic welding technology so as to form three channels (not shown) between the channel plates 1141, 1142 and 1143 and the rising strips 121, respectively. In such way, the inks contained in the ink chambers could flow through these channels into the exit region 1144, and then injected by a nozzle (not shown).

The ultrasonic welding technology is widely used to weld plastic materials. Such technology is performed by utilizing an ultrasonic frequency, e.g. 20 KHz, to vibrate two plastic articles on their contact areas. Then, the molecules on the contact areas are heated due to the vibration of molecules. When the temperature reaches the melting point of the plastic articles, the vibration will be stopped and thus the heated contact areas cool down. Meanwhile, these two plastic articles are welded together. By using the ultrasonic welding technology to weld the bottom cover plate 12 onto the bottom surface 114 of main body 11, a so-called stress-whitening phenomenon occurs. The stress-whitening phenomenon leads to some fractures on the contact areas, and thus results in ink leakages. In addition, some fibers and/or particulates might be generated on the contact areas, which readily blocks discharge of the inks. It is known that the above disadvantages also occur when the top cover plate 13 is welded onto the top surface of the main body 11. Furthermore, due to arrangement of the exit ports 1110, 1120 and 1130, the total length of the channels is very long and results in high friction as the inks flow therethrough. Such relatively long channel length also leads to an inferior molding evenness and an increase of welding variance.

SUMMARY OF THE INVENTION

It is an object of the present invention to provide a structure of an ink cartridge and a method for producing such ink cartridge so as to overcome the drawbacks of ultrasonic welding technologies.

It is another object of the present invention to provide a structure of an ink cartridge for reducing flow friction of inks.

In accordance with an aspect of the present invention, there is provided a structure of an ink cartridge. The structure comprises a main body, a first sealing element and a second sealing element.

The main body comprises a first, a second and a third chambers for storing a first, a second and a third inks, respectively. The first chamber is separated with the second and the third chambers via a first partitioning plate. The second chamber is separated with the third chamber via a second partitioning plate. The first partitioning plate is substantially perpendicular to the second partitioning plate. The first, the second and the third chamber have a first, a second and a third exit ports at bases thereof. The first exit port is directly used as a first opening for flowing out the first ink.

The first sealing element is used for defining a second opening and a first channel along with a bottom surface of the main body, wherein the second opening is located at a first side of the first opening for flowing out the second ink, and the first channel extends from the second exit port to the second opening.

The second sealing element is used for defining a third opening and a second channel along with the bottom surface of the main body, wherein the third opening is located at a second side of the first opening for flowing out the third ink, and the second channel extends from the third exit port to the third opening.

In an embodiment, the first, the second and the third openings are substantially at equivalent levels, and the level of the first exit port is lower than those of the second and the third exit ports.

In an embodiment, the second and the third exit ports are located in the vicinity of the first partitioning plate and substantially symmetrical with respect to the second partitioning plate.

Preferably, the first and the second sealing elements are made of transparent materials.

In an embodiment, the structure of the ink cartridge further comprises a first and a second cover plates cooperated to be engaged with a top surface of said main body.

In accordance with another aspect of the present invention, there is provided a method for producing an ink cartridge. The method comprises steps of (a) molding a first plastic material to form a main body of the ink cartridge; (b) molding a first and a second sealing elements; and (c) injecting a second plastic material into a space between the first and the second sealing elements and a bottom surface of the main body so as to define channels and openings for inks to flow therethrough.

Preferably, the steps (a) and (b) are simultaneously performed by a injection molding process.

In an embodiment, the first plastic material has a melting point higher than that of the second plastic material, and the first and the second sealing elements are made of a transparent material.

In an embodiment, the first plastic material is a polycarbonate resin, and the second plastic material is an acrylonitile-butadiene-styrene copolymer.

The above objects and advantages of the present invention will become more readily apparent to those ordinarily skilled in the art after reviewing the following detailed description and accompanying drawings, in which:

BRIEF DESCRIPTION OF THE DRAWINGS

FIG. 4(*b*) is a bottom exploded view of FIG. 4(*a*);

FIG. 5(*b*) is a perspective view illustrating an assembly of the two sealing elements, the connecting plate and the main body in FIG. 4;

DETAILED DESCRIPTION OF THE PREFERRED EMBODIMENT

Figure 1:
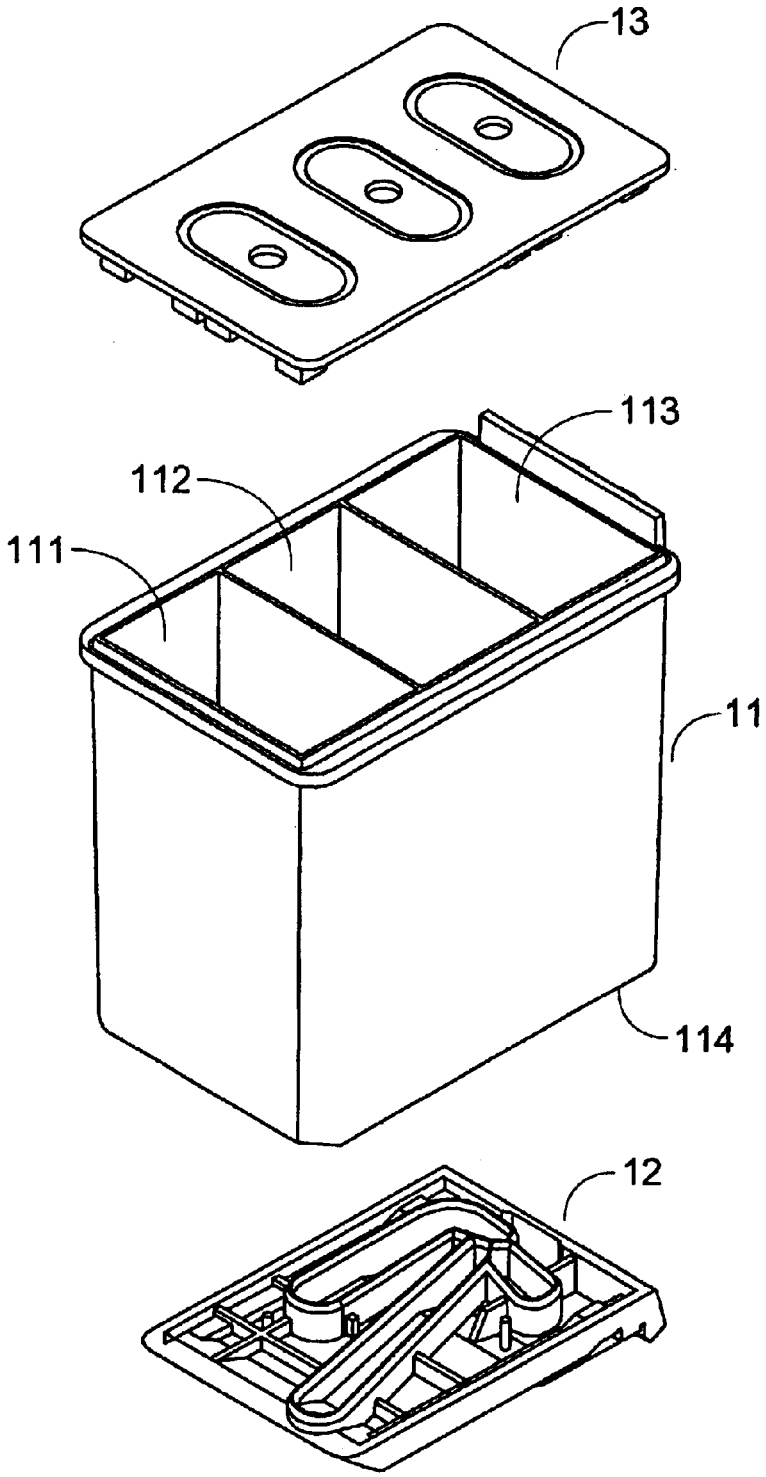
Fig.1 PRIOR ART
FIG. 1 is an exploded view illustrating a structure of a conventional ink cartridge.
Figure 2:
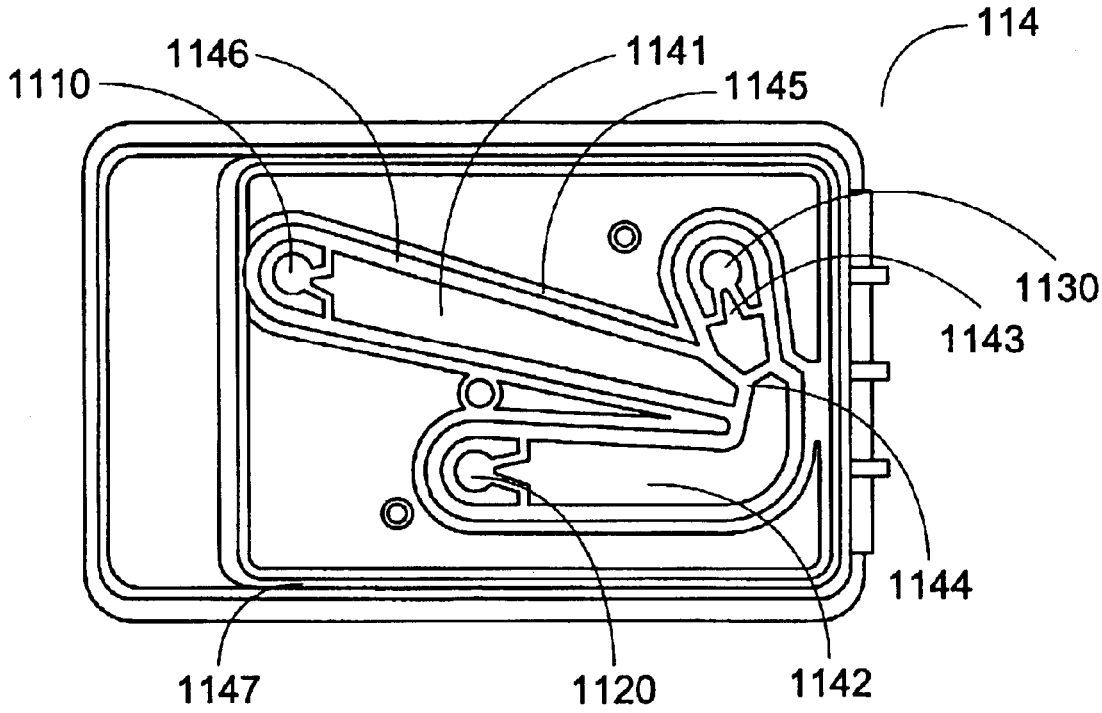
Fig.2 PRIOR ART
FIG. 2 is a bottom view illustrating a bottom surface of a main body of the ink cartridge in FIG. 1.
Figure 3:
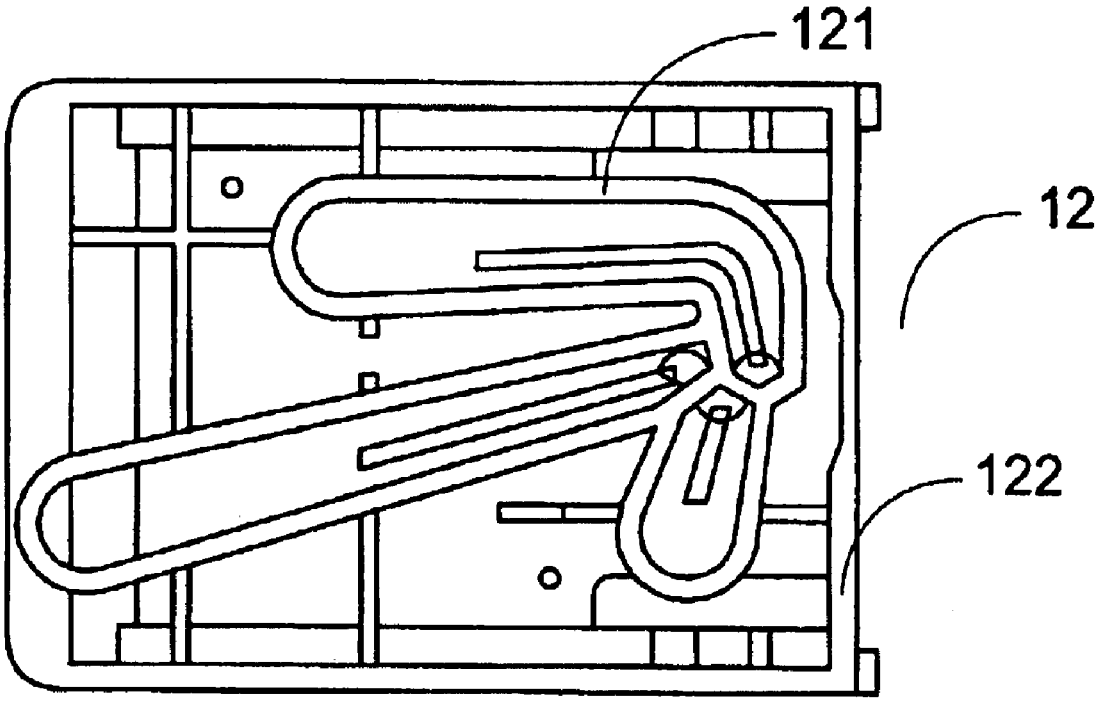
Fig.3 PRIOR ART
FIG. 3 is a top view illustrating a bottom cover plate of the ink cartridge in FIG. 1.
Figure 4A:
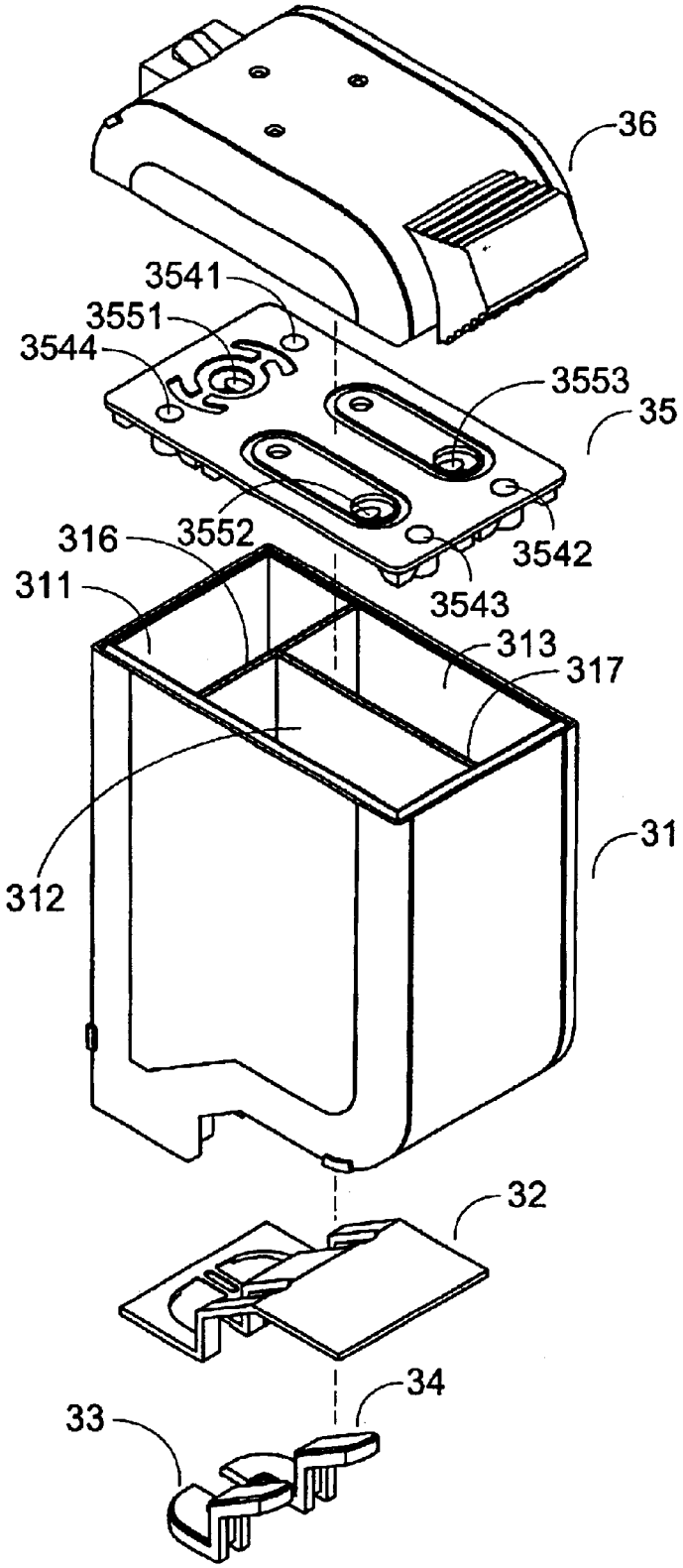
FIG. 4(*a*) is a top exploded view illustrating a structure of an ink cartridge according to a preferred embodiment of the present invention.
Figure 4B:
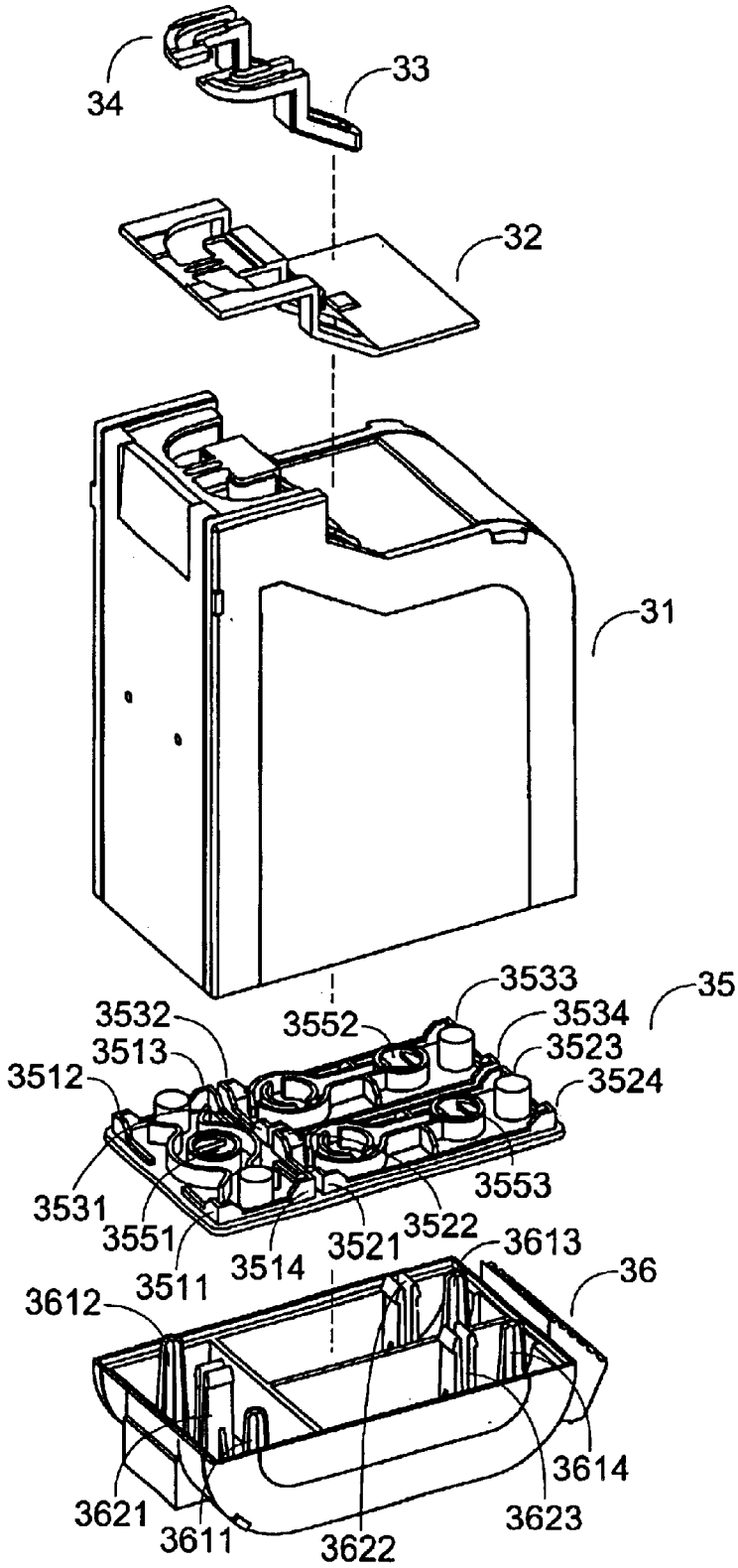

Please refer to FIGS. 4(*a*) and 4(*b*). The structure of an ink cartridge according to a preferred embodiment of the present invention comprises a main body 31, a connecting plate 32, a first sealing element 33, a second sealing element 34, a first cover plate 35 and a second cover plate 36. The main body 31 along with the connecting plate 32, the first sealing element 33 and the second element 34 define channels and openings for inks to flow therethrough. The first cover plate 35 and the second cover plate 36 are engaged with the top surface of the main body 31 for preventing ink leakage.

Please refer to FIG. 4(*a*). The main body 31 comprises three ink chambers 311, 312, 313 for storing different colors of inks such as red, yellow and blue ink. The ink chamber 311 is separated with the inks chambers 312 and 313 via a first partitioning plate 316. The ink chamber 312 is separated with the inks chamber 313 via a second partitioning plate 317. The first partitioning plate 316 is substantially perpendicular to the second partitioning plate 317. Otherwise, the first partitioning plate 316 is deviated from the second partitioning plate 317 by a specified angle.

Figure 5A:
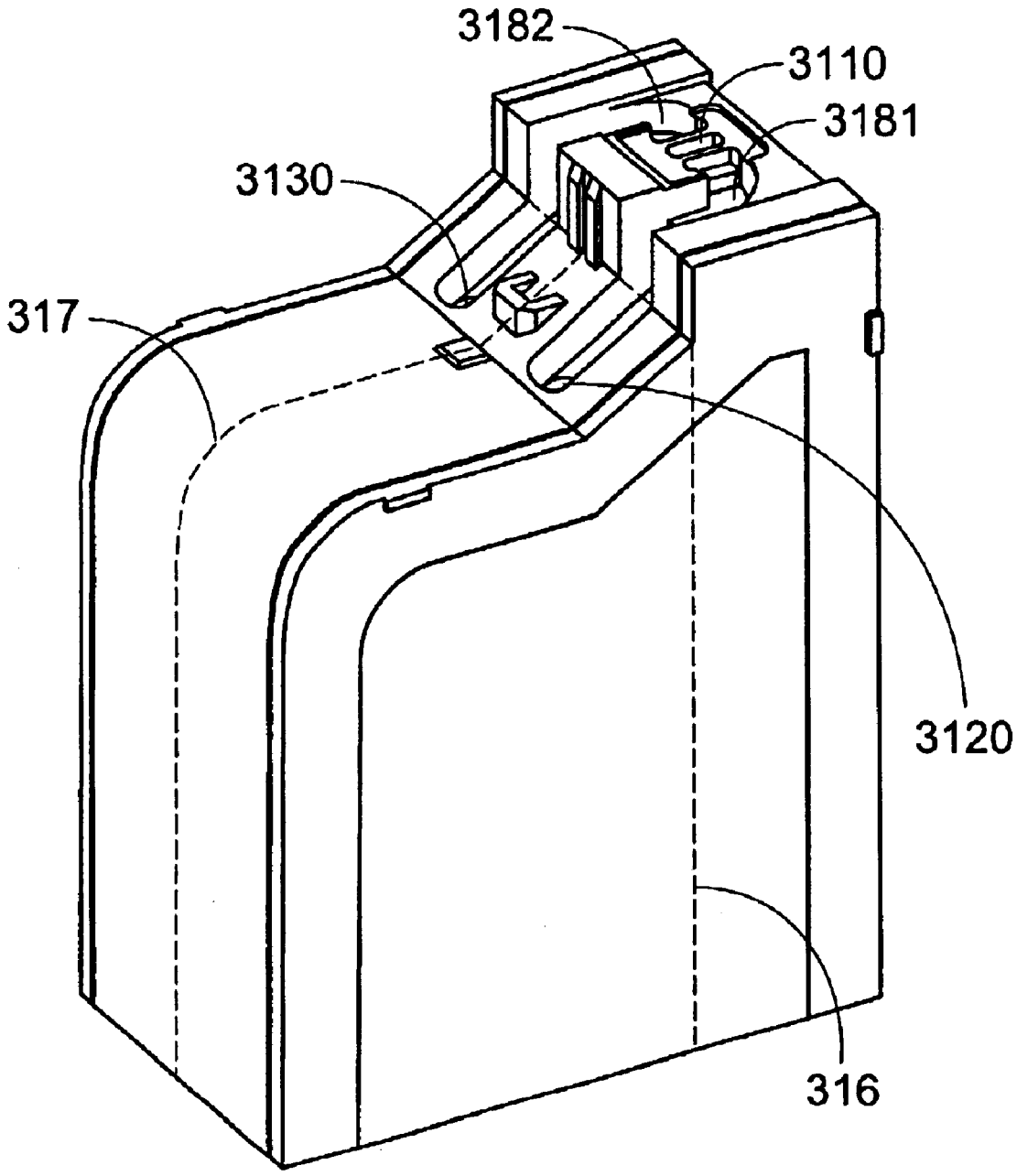
FIG. 5(*a*) is a perspective view illustrating an assembly of the connecting plate and the main body in FIG. 4.
Figure 5B:
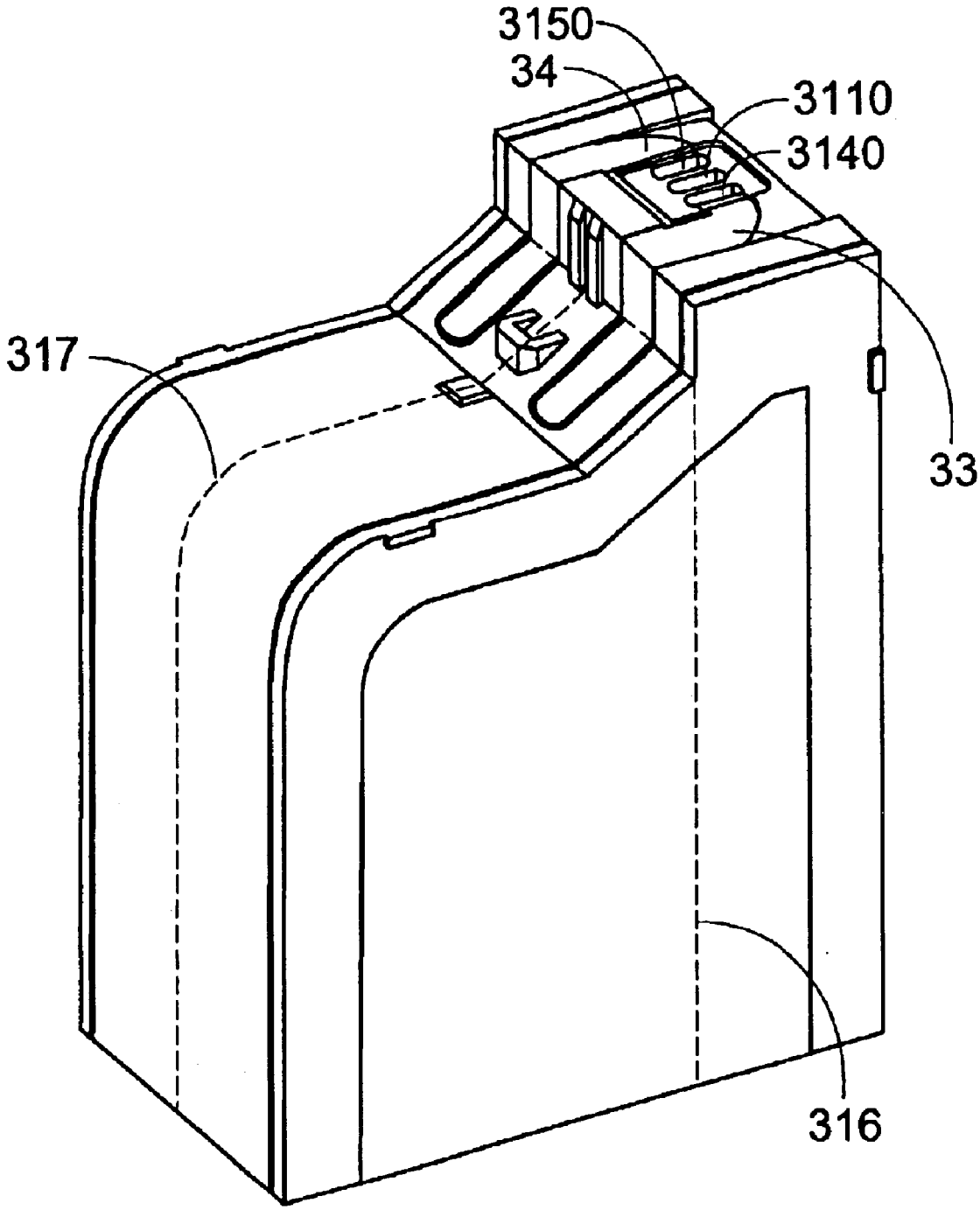

FIG. 5(*a*) illustrates an assembly of the main body 31 and the connecting plate 32. The connecting plate 32 along with the main body 31 defines exit ports 3110, 3120, 3130 and tunnels 3181, 3182 at bases thereof. For a purpose of shortening total channel length and reducing flow friction, the exit port 3110 is directly used as a first opening for flowing out the first ink. The exit ports 3120 and 3130 are preferably located in the vicinity of the first partitioning plate 316, and substantially symmetrical with respect to the second partitioning plate 317. Especially, under normal operation (the ink cartridge is placed upside down), the level of the exit port 3110 is lower than those of the exit ports 3120 and 3130 so as to facilitate the inks to flow down the tunnels 3181 and 3182.

As shown in FIG. 5(*b*), after the first sealing element 33 and the second element 34 are fitted into the top locations of the tunnels 3181 and 3182, respectively, two channels (not shown) between the tunnels and the sealing elements and two openings 3140, 3150 are defined for guiding the second ink and the third ink containing in the ink chambers 312 and 313 to flow out. In this embodiment, the three openings 3110, 3140 and 3150 are substantially at equivalent levels.

Figure 6:
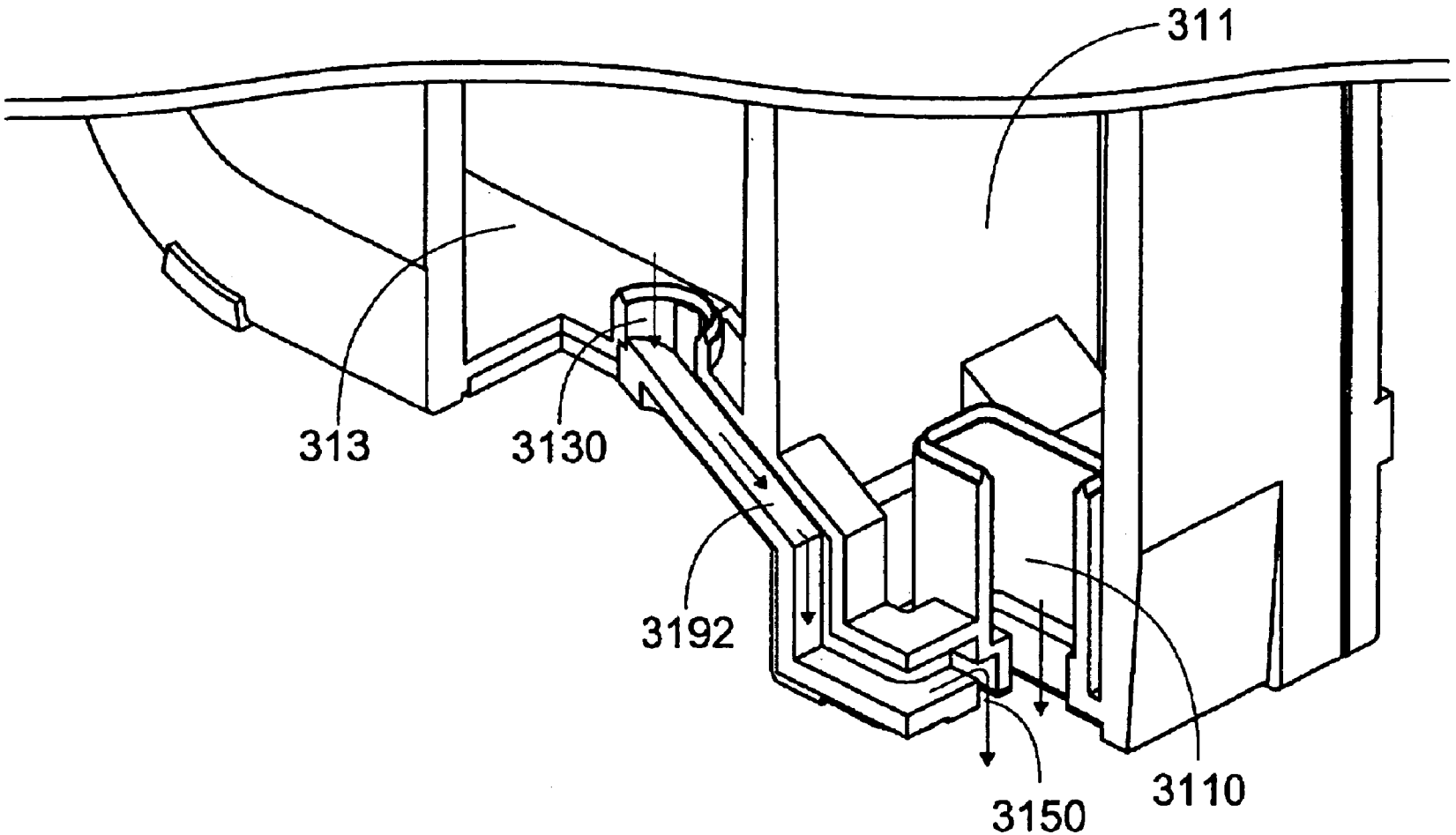
FIG. 6 is a partial sectional view illustrating paths of inks flowing in the ink cartridge of the present invention.

FIG. 6 is a partial sectional view illustrating paths of inks flowing in the ink cartridge of the present invention. The ink containing in the ink chamber 311 could directly drop down into the exit port 3110 and then flow out. The ink containing in the ink chamber 313 will flow from the exit port 3130 to the opening 3150 via a channel 3192 defined by the tunnel 3182 (as shown in FIG. 5(*a*)) and the second sealing element 34 (as shown in FIG. 5(*b*)).

Please refer again to FIGS. 4(*a*) and 4(*b*). The first cover plate 35 faced to the top surface of the main body 31 comprises a plurality of protruding sheets 3511–3514, 3521–3524, 3531–3534 corresponding to top rims of the ink chambers 311, 312 and 313 for preventing ink leakage from the top surface of the main body 31. The first cover plate 35 faced to the second cover plate 36 comprises cavities 3541–3544 fitted with rods 3611–3614 of the second cover plate 36 so as to prevent horizontal movement of each other. The first cover plate 35 also comprises holes 3551–3553 fitted with clipping sheets 3621–3623 of the second cover plate 36 so as to prevent vertical movement of each other. By using the first cover plate 35 and the second cover plate 36, the top surface of the main body 31 is well sealed accordingly.

The method for producing the ink cartridge of the present invention can be illustrated as the following steps:

(a) By using an injection molding procedure, a first plastic material is injected into a cavity of a mold (not shown), thereby forming the main body 31, and the sealing elements 33 and 34.

(b) The sealing elements 33 and 34 are moved to predetermined positions for defining channels, and then injecting a second plastic material into a space between the sealing elements and a bottom surface of the main body (i.e. a space corresponding to the connecting plate 32).

In the step (a), the main body 31 and the sealing elements 33, 34 could be separately molded, and more preferably, they are molded simultaneously. The first plastic material has a melting point higher than that of the second plastic material. In preferred embodiments, the first and the second plastic materials are a polycarbonate resin and an acrylonitile-butadiene-styrene copolymer, respectively. For a purpose of examining flow patterns of the inks, the sealing elements 33 and 34 are made of a transparent material.

As will be apparent from the above description according to the present invention, the structure and method for producing the ink cartridge has some advantages when comparing with the prior art. Firstly, since the present invention is performed by plastic molding process to assemble the main body and sealing elements, the drawbacks of ultrasonic welding technologies such as stress-whitening phenomenon and ink leakage could be effectively overcome, and the ink cartridge of the present invention has excellent air-proof and moisture-proof properties. Furthermore, since the top surface of the main body is engaged with the cover plates via clipping action, the drawbacks of ultrasonic welding technologies could be avoided. Furthermore, the inks containing in the ink chambers could flow more smoothly due to a shorter overall length of channels and different levels between exit ports and openings.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims, which are to be accorded with the broadest interpretation so as to encompass all such modification and similar structures.

What is claimed is:

1. A structure of an ink cartridge, comprising:

a main body having a first, a second and a third chambers for storing a first, a second and a third inks, respectively, wherein said first chamber is separated with said second and said third chambers via a first partitioning plate, said second chamber is separated with said third chamber via a second partitioning plate, said first partitioning plate is connected to said second partitioning plate, said first, said second and said third chambers have a first, a second and a third exit ports at bases thereof, and said first exit port is directly used as a first opening for flowing out said first ink;

a first sealing element for defining a second opening and a first channel along with a bottom surface of said main body, said second opening being at a first side of said first opening for flowing out said second ink, and said first channel extending from said second exit port to said second opening; and a second sealing element for defining a third opening and a second channel along with said bottom surface of said main body, said third opening being at a second side of said first opening for flowing out said third ink, and said second channel extending from said third exit port to said third opening.

2. The structure according to claim 1 wherein said first, said second and said third openings are substantially at equivalent levels.

3. The structure according to claim 1 wherein the level of said first exit port is lower than those of said second and said third exit ports.

4. The structure according to claim 1 wherein said first partitioning plate is substantially perpendicular to said second partitioning plate.

5. The structure according to claim 1 wherein said second and said third exit ports are located in the vicinity of said first partitioning plate.

6. The structure according to claim 5 wherein said second and said third exit ports are substantially symmetrical with respect to said second partitioning plate.

7. The structure according to claim 1 further comprising a first and a second cover plates cooperated to be engaged with a top surface of said main body, wherein said first cover plate is directly fixed to the top surface of said main body and said second cover plate is directly fixed to said first cover plate.

8. The structure according to claim 7 wherein said first cover plate comprises a plurality of protruding sheets corresponding to the top rims of said first, said second and said third chambers for preventing ink leakage from the top surface of said main body, and a plurality of holes and cavities.

9. The structure according to claim 8 wherein said second cover plate comprises a plurality of rods fitted with said cavities of said first cover plate so as to prevent horizontal movement of each other, and a plurality of clipping sheets fitted with said holes of said first cover plate so as to prevent vertical movement of each other.

10. The structure according to claim 1 wherein said first and said second sealing elements are made of transparent materials.

11. A method for producing an ink cartridge, comprising the steps of:

(a) molding a first plastic material to form a main body of said ink cartridge;

(b) molding a first and a second sealing elements; and (c) injecting a second plastic material into a space between said first and said second sealing elements and a bottom surface of said main body so as to define channels and openings for inks to flow therethrough.

12. The method according to claim 11 wherein said steps (a) and (b) are simultaneously performed by an injection molding process.

13. The method according to claim 11 wherein said first plastic material has a melting point higher than that of said second plastic material.

14. The method according to claim 11 wherein said first plastic material is a polycarbonate resin, and said second plastic material is an acrylonitile-butadiene-styrene copolymer.

15. The method according to claim 11 wherein said main body comprises a first, a second and a third chambers for storing a first, a second and a third inks, respectively, wherein said first chamber is separated with said second and said third chambers via a first partitioning plate, said second chamber is separated with said third chamber via a second partitioning plate, said first partitioning plate is substantially perpendicular to said second partitioning plate, said first, said second and said third chambers have a first, a second and a third exit ports at bases thereof, and said first exit port is directly used as a first opening for flowing out said first ink.

16. The method according to claim 15 wherein said first sealing element defines a second opening and a first channel along with a bottom surface of said main body, wherein said second opening is at a first side of said first opening for flowing out said second ink, and said first channel extends from said second exit port to said second opening; and said second sealing element defines a third opening and a second channel along with said bottom surface of said main body, wherein said third opening is at a second side of said first opening for flowing out said third ink, and said second channel extends from said third exit port to said third opening.

17. The method according to claim 11 wherein said first and said second sealing elements are made of a transparent material.

18. A method for producing an ink cartridge, comprising the steps of:

molding a first plastic material to form a main body of said ink cartridge, a first sealing element and a second sealing element, simultaneously; and injecting a second plastic material into a space between said first and said second sealing elements and a bottom surface of said main body so as to define channels and openings for inks to flow therethrough.

19. The method according to claim 18 wherein said first plastic material has a melting point higher than that of said second plastic material.

20. The method according to claim 18 wherein said first plastic material is a polycarbonate resin, and said second plastic material is an acrylonitile-butadiene-styrene copolymer.

* * * * *